US007350566B2

(12) United States Patent
Valenti et al.

(10) Patent No.: US 7,350,566 B2
(45) Date of Patent: Apr. 1, 2008

(54) WELL COMPLETION WITH MERGED INFLUX OF WELL FLUIDS

(76) Inventors: Nicholas P. Valenti, Ole Olsens Alle 2, 2900 Hellerup (DK); Richard M. Valenti, 1442 Kingwood Dr., No. 134, Kingwood, TX (US) 77339

( * ) Notice: Subject to any disclaimer, the term of this patent is extended or adjusted under 35 U.S.C. 154(b) by 318 days.

(21) Appl. No.: 10/511,412

(22) PCT Filed: Apr. 17, 2003

(86) PCT No.: PCT/US03/11928

§ 371 (c)(1),
(2), (4) Date: Jun. 14, 2005

(87) PCT Pub. No.: WO03/089752

PCT Pub. Date: Oct. 30, 2003

(65) Prior Publication Data

US 2005/0230105 A1 Oct. 20, 2005

(51) Int. Cl.
*E21B 17/00* (2006.01)

(52) U.S. Cl. ..... 166/242.3
(58) Field of Classification Search ..... None
See application file for complete search history.

(56) References Cited

U.S. PATENT DOCUMENTS

| | | | |
|---|---|---|---|
| 1,620,412 | A | 3/1927 | Tweeddale |
| 6,073,659 | A | 6/2000 | Lange et al. |
| 6,276,458 | B1 | 8/2001 | Malone et al. |

FOREIGN PATENT DOCUMENTS

| | | | |
|---|---|---|---|
| DE | 10 57 779 | B | 5/1959 |
| FR | 1482020 | A | 8/1967 |

*Primary Examiner*—Frank Tsay
(74) *Attorney, Agent, or Firm*—John R. Casperson

(57) ABSTRACT

The objective of the invention is to smoothly merge the influx flow streams with the wellbore flow stream so as to reduce the pressure drop along the perforated section of the wellbore liner. There is disclosed a completion liner for a well for the production of hydrocarbons is provided with angled ports through the sidewall which reduce pressure drop along the length of the liner. There is also disclosed short imperforate completion tubing for a well for the production of hydrocarbons is concentrically mounted alongside substantially only the perforated section of the production tubing to cause production fluids to initially flow toward the wellhead along an annulus defined between completion tubing and the production tubing prior to exiting the annulus and commingling a with fluids produced from further down hole. There is further disclosed a completion casing for a well for the production of hydrocarbons which is provided with angled perforations through the casing sidewall which reduce flow resistance along the length of the casing.

25 Claims, 9 Drawing Sheets

WELL COMPLETION WITH MERGED INFLUX OF WELL FLUIDS

TECHNICAL FIELD

The invention relates generally to the reduction of flow resistance of fluids flowing from a production zone and along a wellbore.

BACKGROUND ART

Much attention and engineering has been performed to address the pressure drop that occurs as a result of fluid flowing into a wellbore. Solutions to minimize the pressure drop include such efforts as wellbore damage remediation, fracture stimulation, gravel packing and horizontal completions. All of these efforts attempt to address the pressure drop that occurs between the reservoir and the center of the wellbore.

In conventional, vertical wells the pressure drop occurring along the length of the completion is assumed negligible because the typical length of the completion is usually on the order of 10's of feet. This compares to the 1000's of feet of tubing between the wellhead and producing interval. However, for horizontal wells, the length of the completion can be as long as the vertical depth of the well. It is common industry practice to have horizontal completions that are 100's to 1000's of feet in length. Due to this substantially longer completion interval, for a horizontal well in comparison to the vertical well, the pressure drop occurring along the length of the completion is no longer insignificant.

The pressure drop along the length of the completion is sufficiently large to result in a non-uniform inflow of fluids along the length of the completion. An SPE (Society of Petroleum Engineering) Paper published in 1996 by Tang, Ozkan, Kelkar, Sarica and Yildiz shows the significance of this pressure drop. These findings are based on their work, which was organized as a joint industry project, titled: "Optimization of Horizontal-Well Completion II." As presented in the SPE paper, the fluid flow into the wellbore is non-uniform. The highest contribution of fluid is at the heel of the completion. The fluid rate at the heel is more than four times the fluid rate at the center of the completion and almost two times the fluid rate at the toe of the completion. This variation in fluid inflow is due to the pressure drop resulting from non-parallel flow lines within the wellbore. The fluid flow paths literally collide with each other within the wellbore, which results in the turbulent-like fluid flow behavior.

New completion techniques designed to minimize the pressure drop that occurs due to the confluence of flow into the wellbore would be very desirable. Such techniques would be expected to provide the greatest benefit for horizontal wells due to the length of their completions. However, the techniques would also be beneficial for vertical wells with long and/or commingled completions.

By pursuing this objective, the new completion techniques should prove effective in 1) increasing the well's total productivity and 2) increasing the uniformity of inflow (conformance) along the length of the completion.

DISCLOSURE OF INVENTION

Broadly speaking, the invention is to provide well completion with merging influx streams.

Liner Perforations

In one embodiment of the invention, there is provided a well for the production of hydrocarbons. The well comprises a borehole extending into the earth from the surface of the earth into a hydrocarbon production zone and a well production tubular positioned in the borehole. Preferably, the production tubular is positioned in a casing which lines the well. The well production tubular has a longitudinal axis, a generally annular cross section across the longitudinal axis, a wellhead end, a well bottom end, and a plurality of influx ports opening through a sidewall of the tubular along a segment of the tubular positioned in the hydrocarbon production zone. The influx ports form a plurality of flow paths from an outer surface of the tubular to an inner surface of the tubular and are formed so that substantially all hydrocarbon flowing from the hydrocarbon production zone and into the tubular exits the influx ports with a substantial axial component toward the wellhead end of the tubular and/or a rotational velocity component.

Concentric Tubing and Packer System

In another embodiment of the invention, there is provided a well for the production of hydrocarbons. The well includes a borehole, a production tubing, and a completion tubing. The borehole extends into the earth from a wellhead at the surface of the earth and into a hydrocarbon production zone. The production tubing is positioned in the borehole and extends into the hydrocarbon production zone from the wellhead. The production tubing has a first perforated section positioned in the hydrocarbon production zone and a second perforated section positioned between the first perforated section and the wellhead. The completion tubing has an inlet end, an outlet end, and a longitudinal axis extending between the ends. A first mounting device is positioned on an outside surface of the completion tubing near the inlet end of the completion tubing and mounts the inlet end of the completion tubing to an inside surface of the production tubing between the first perforated section and the second perforated section. A second mounting device is positioned on the outside surface of the completion tubing near the outlet end of the completion tubing and mounts the outlet end of the completion tubing to the inside surface of the well production tubing between the second perforated section and the wellhead. Fluid flowing into the production tubing through the perforations of the second perforated section flows into an annulus defined between the completion tubing and the production tubing.

Casing Perforations

In a further embodiment of the invention, there is provided a well for the production of hydrocarbons having a casing which has been perfed to provide low resistance to flow across the completion zone. The well comprises a well bore and a casing. The well bore extends into the earth from the surface of the earth into a hydrocarbon production zone. The well bore casing is positioned in the borehole and has a longitudinal axis, a generally annular cross section across the longitudinal axis, a wellhead end, a well bottom end, and a plurality of perforations opening through a sidewall of the casing along a segment of the casing positioned in the hydrocarbon production zone. The perforations form plurality of flow paths from an outer surface of the casing to an inner surface of the casing and are formed through the sidewall at an obtuse angle with respect to the longitudinal axis of the casing in the direction of the wellhead end so that substantially all hydrocarbon flowing from the hydrocarbon production zone and into the casing exits the perforations with a substantial axial velocity component toward the wellhead end of the casing.

BEST MODE FOR CARRYING OUT THE INVENTION

Figure 1:
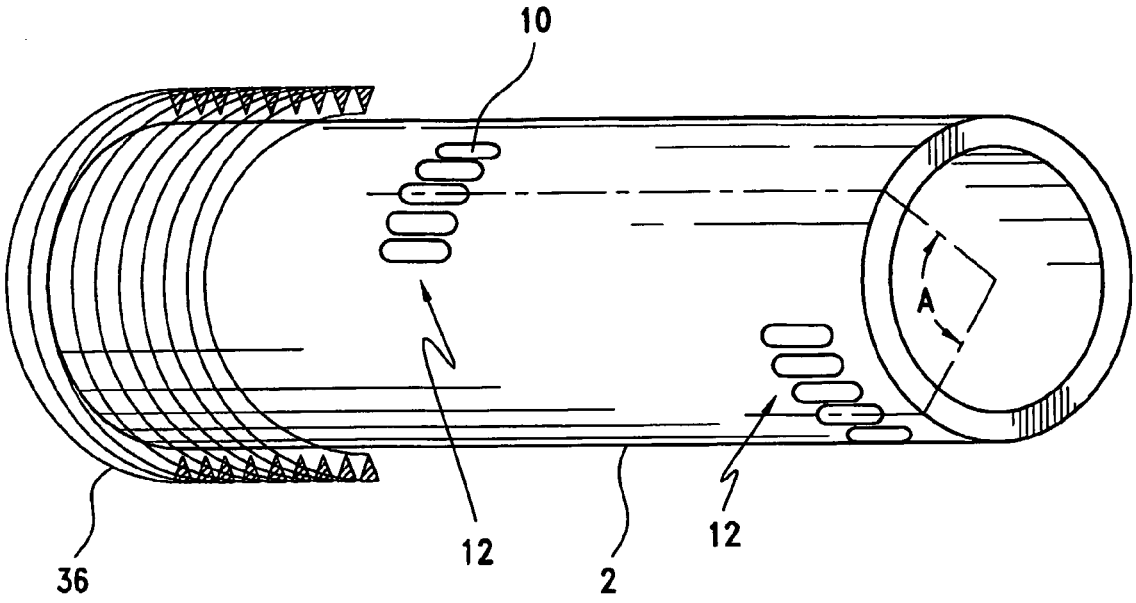
FIG. 1 is a schematic illustration of a liner segment which is provided with holes angled axially to reduce flow resistance due to influx across a completion interval of a well.
Figure 2:
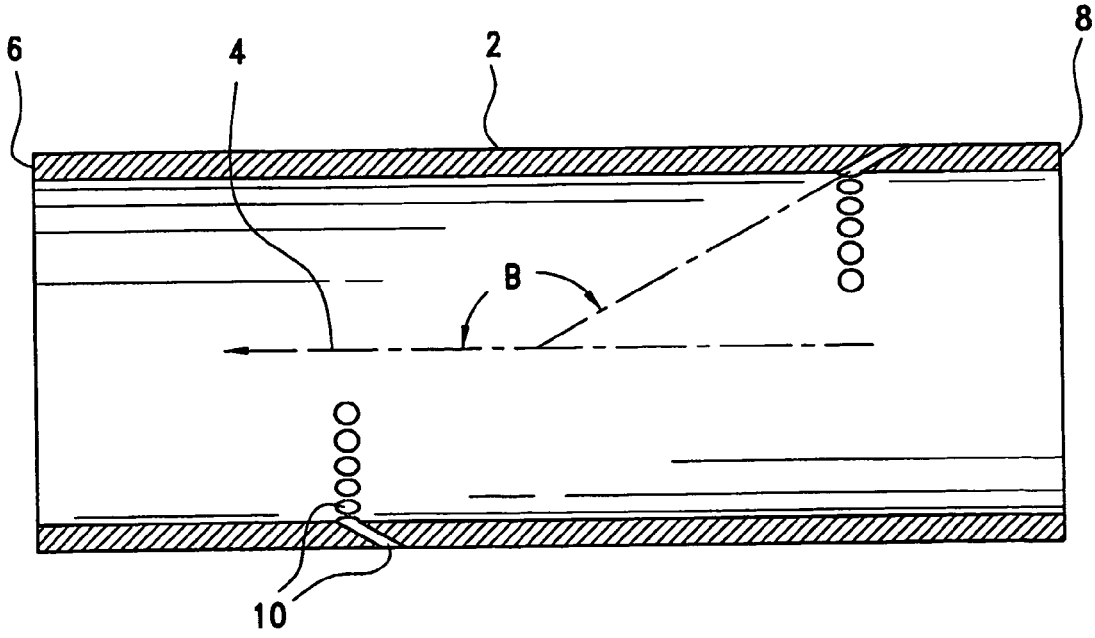
FIG. 2 is a longitudinal section of the liner segment shown in FIG. 1.
Figure 3:
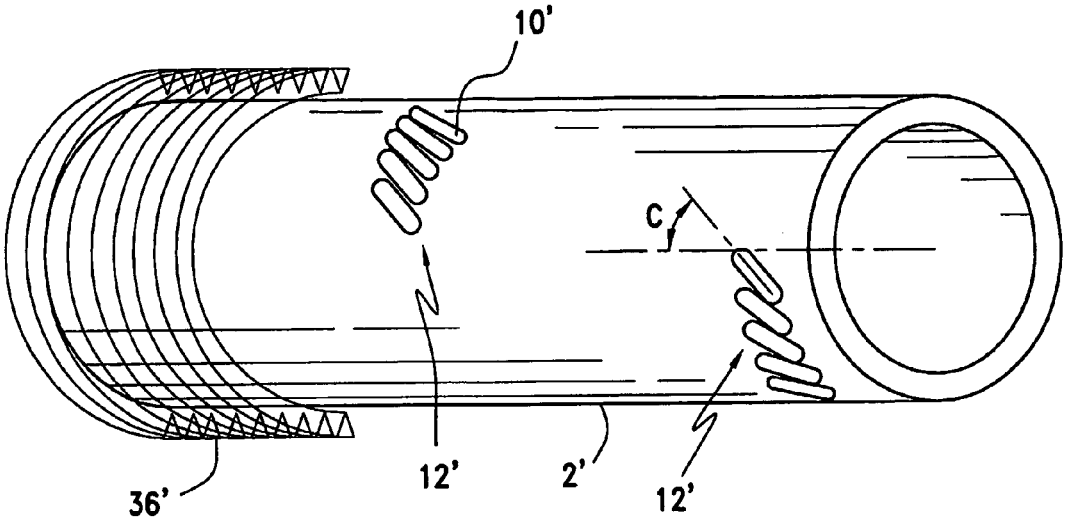
FIG. 3 is a schematic illustration of a liner segment which is provided with holes angled for spiral flow of fluids into the liner to reduce flow resistance across the completion interval.
Figure 4:
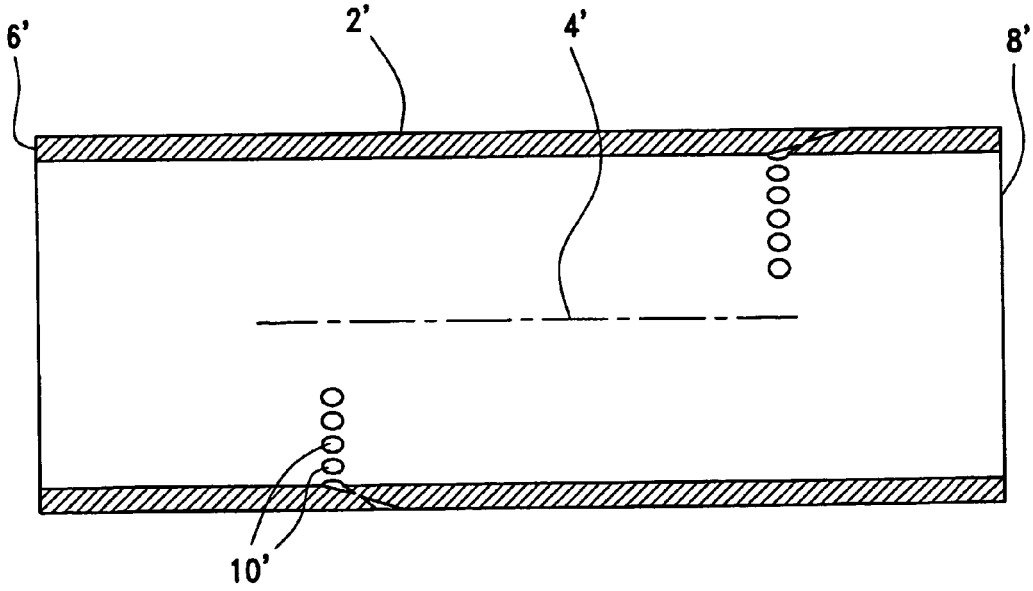
FIG. 4 is a longitudinal section of the liner shown in FIG. 3.
Figure 5:
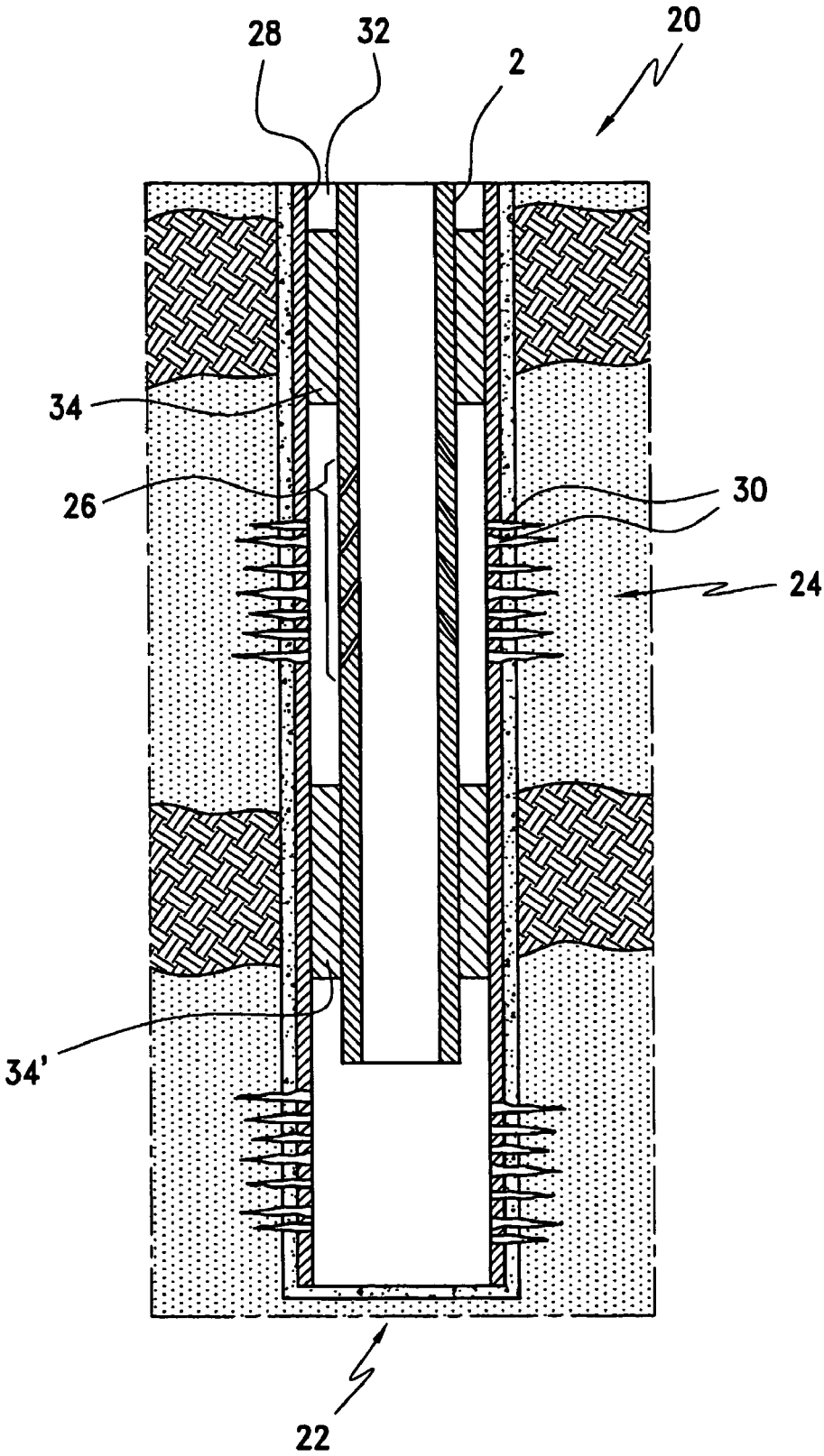
FIG. 5 illustrates in longitudinal section one use of an inventive liner in a vertical well.
Figure 6:
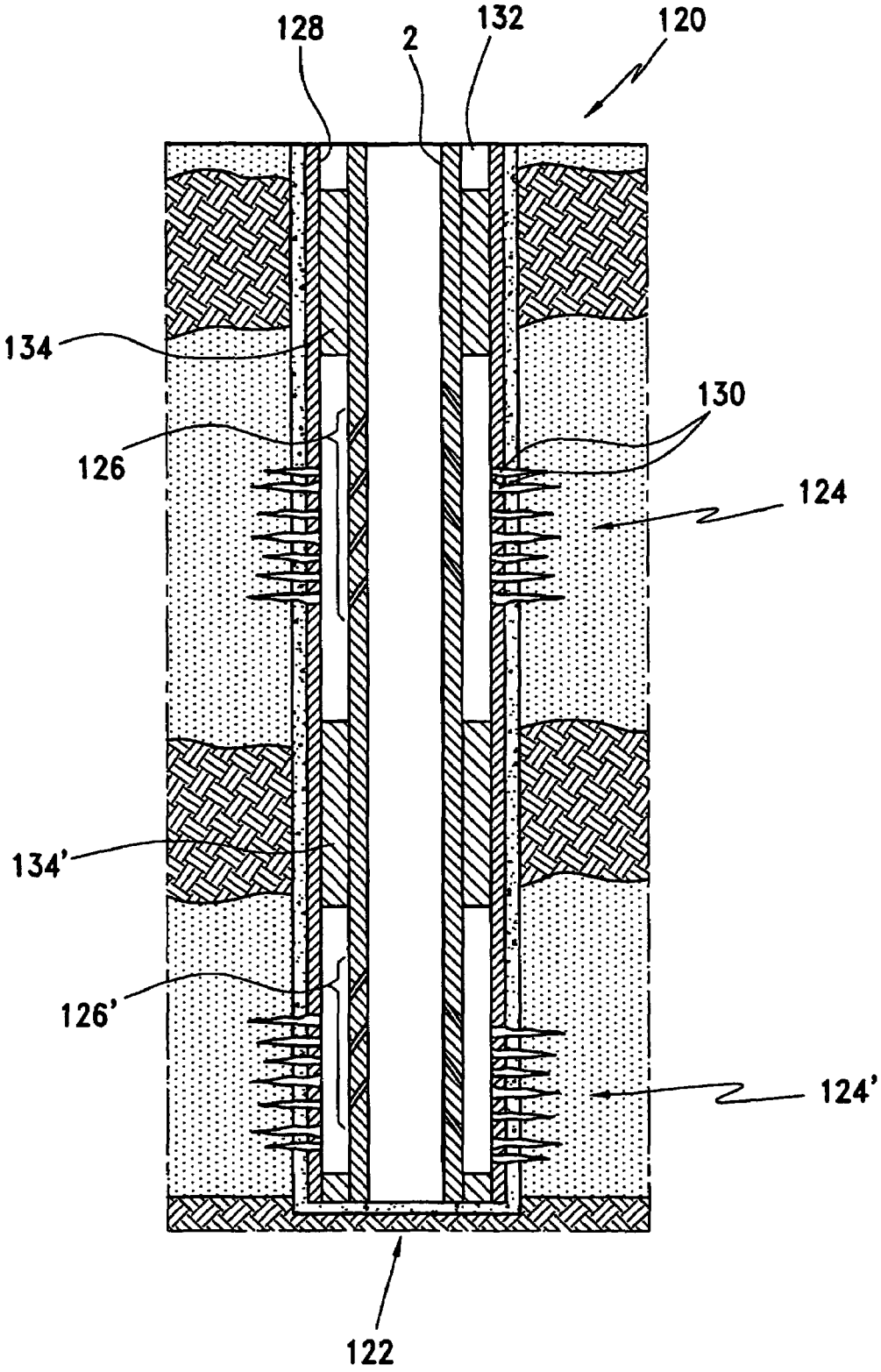
FIG. 6 illustrates in longitudinal section another use of an inventive liner in a vertical well.
Figure 7:
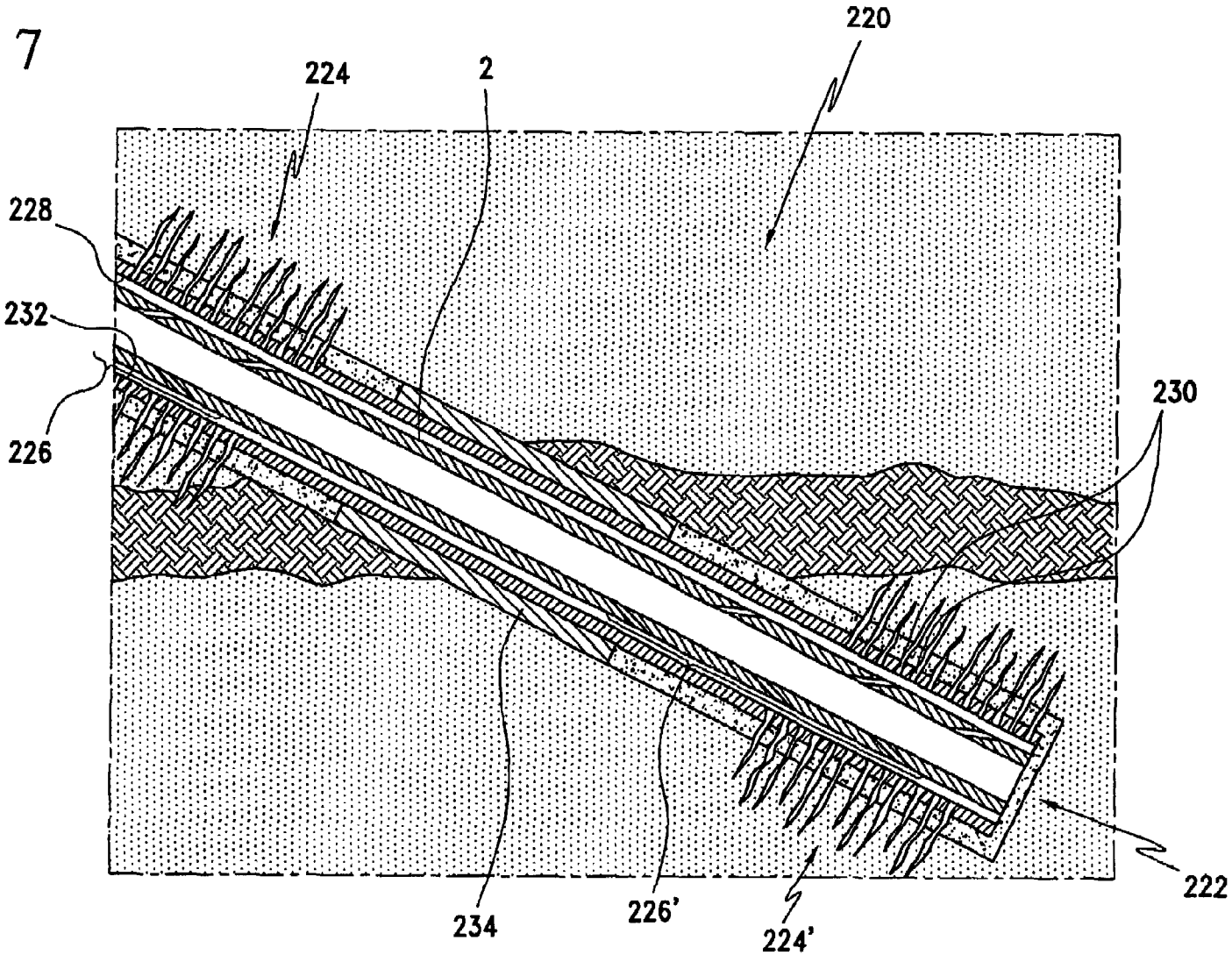
FIG. 7 illustrates in longitudinal section one use of an inventive liner in a highly deviated well.
Figure 8:
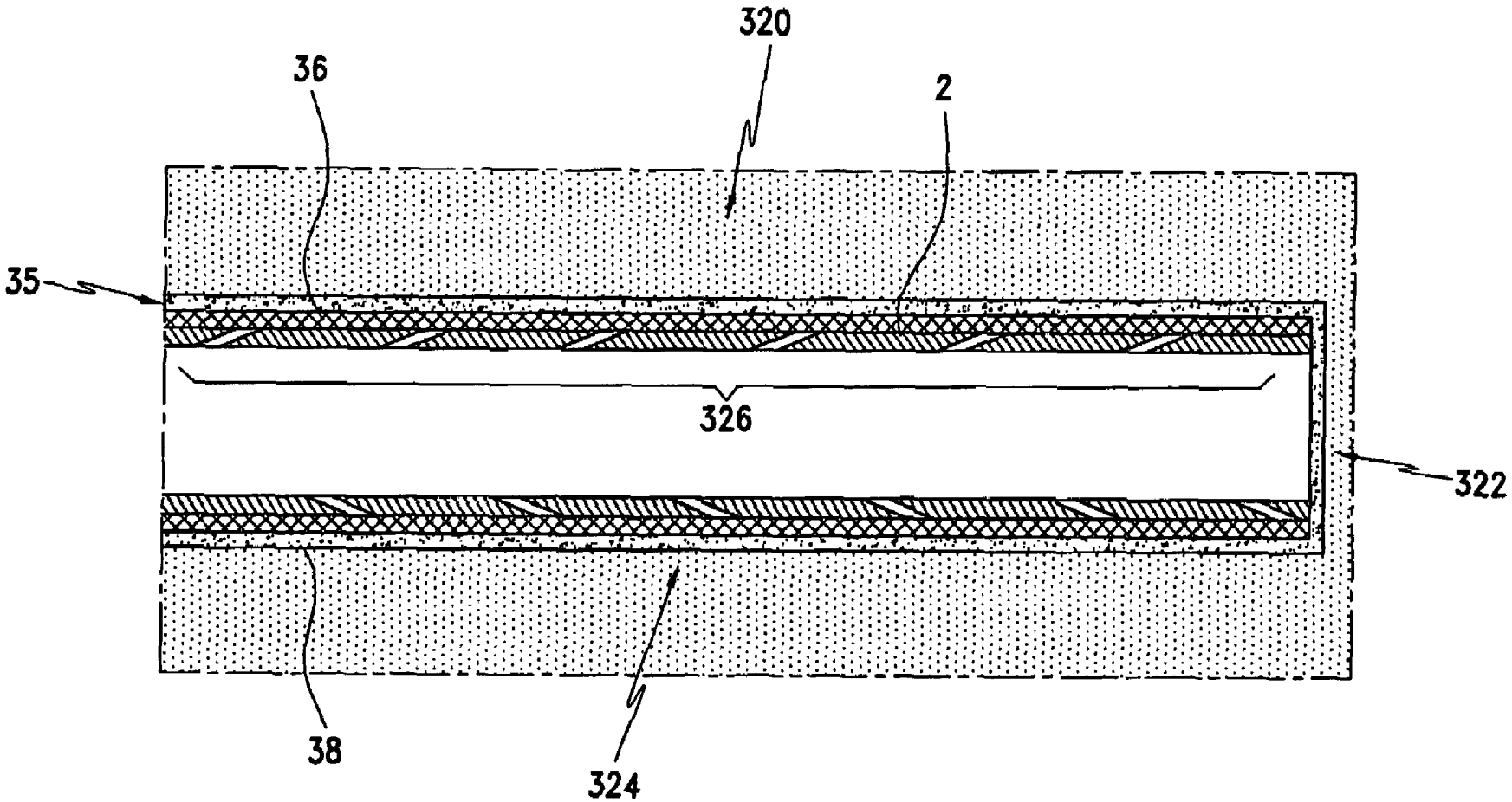
FIG. 8 illustrates in longitudinal section one use of an inventive liner in a horizontal well.

The objective of the invention is to smoothly merge the influx flow streams with the wellbore flow stream so as to reduce the pressure drop along the perforated section of the wellbore liner. Three embodiments for carrying out this objective are liner perforations, a concentric tubing and packer system, and casing perforations.

Liner Perforations

The first described embodiment of the invention employs a liner perfed for angled fluid influx to accomplish this. See FIGS. 1-8. By perfed is meant provided with holes or ports. In practice, the holes or ports would be provided by machine operation such as milling prior to placement in the wellbore. The techniques specifically disclosed to accomplish the pressure drop reduction are: (1) liner perfed for axial fluid influx; (2) liner perfed for spiraling fluid influx.

Liner Perfed for Axial Fluid Influx

In an axial-perf liner, the perfs have an inclination angle of other than 90° and a 0° rotation angle. Phrased another way, the perfs open through the sidewall of the tubular directly toward the longitudinal axis of the tubular, but are pointed in the direction of flow of wellbore fluids, so that fluid is emitted from the perf with an axial velocity component but no tangential velocity component. The angle between the axis of the liner and the axis of the perf can range from 10 degrees to 80 degrees, usually between 20 degrees and 45 degrees, and all of the perfs point in the same direction, preferably at the same angle. The situation can be analogized to merge ramps on a highway. Most highways have entrance and exit ramps that merge smoothly in to and out of traffic. That is, the entrance and exit ramps are not perpendicular to the highway. As a result, with the exception of some courteous yielding, vehicles are capable of entering and exiting a highway without slowing down the speed of the other cars on the highway.

Axial perfs will provide lower pressure drop per unit length of liner than normal perfs, all other things being equal. Pressure drop per unit length along the perforated section of the liner can be further reduced by reducing the perf diameter, reducing the number of perfs per unit length, and incrementally changing the position of the axial perfs on the circumference of the liner between adjacent longitudinal positions, so as to bring in the influx flow streams through the perfs from locations around the entire periphery of the liner in a cyclical, crankshaft-layout-type fashion. Where the axial perfs are employed in groups, it is expected that the groups will be positioned in areas best described as circumferentially-extending strips or banks.

Liner Perfed for Spiraling Fluid Influx

In a spiral-perf liner, the perfs would have an inclination angle of other than 90° and an orientation angle of other than 0°. Phrased another way, the perfs open through the sidewall of the tubular so that the axis of the perf is pointed in the direction of flow of wellbore fluids but is directed off of the longitudinal axis of the tubular, so that fluid is emitted from the perf with both a tangential velocity component and an axial velocity component. All of the perfs are co-rotationally directed.

Pressure drop per unit length along the perforated section of the liner can be further reduced by reducing the perf diameter, reducing the number of perfs per unit length of the liner, and incrementally changing the position of the spiral perfs on the circumference of the liner between adjacent longitudinal positions, so as to bring in the influx flow streams from locations around the entire periphery of the liner in a cyclical, crankshaft-layout-type fashion. Where the spiral perfs are employed in groups, it is expected that the groups will be positioned in areas best described as spirally-extending strips or banks.

Further Details of Perfed Liner Embodiments

The liner will generally have an inside diameter of from about 2 inches to about 8 inches (50 mm to 200 mm). The wall thickness of the liner can vary over a wide range, but will usually be in the range of about 5/64ths to 1 inch (2 to 25 mm). The perfs will generally have a longitudinal dimension of less than about 1.5 times the wall thickness, usually less than the wall thickness and preferably less than 0.5 times the wall thickness. Drilled perfs will generally have a diameter in the range of from about 1/8th to 1/2 of an inch (3 to 13 mm).

Where the perfs are deployed in banks, each bank will generally contain in the range of from 1 to 20 perfs, usually in the range of from 2 to 12 perfs. The banks will generally be separated by a phase angle in the range of from about 30 degrees to about 180 degrees, usually in the range of from 45 degrees to 120 degrees, as measured between the centers of the banks, and a distance as measured longitudinally between the banks in the range of from 0.5 to 10, usually 1 to 5, times the inside diameter of the liner.

A major advantage of the angled fluid influx liner is that the holes are smaller, thereby allowing greater control in terms of customizing the orientation and inclination of the openings in the liner. This greater control increases the ability to merge the influx flow streams with the wellbore flow streams. In addition, the small influx holes will provide the desired influx angles with less wall thickness than large holes.

Although small perfs cause a larger pressure drop from the reservoir into the wellbore, this drawback can be mitigated by providing the liner with a series of holes distributed in clusters separated by a phase angle measured about pipe circumference, for example, 90° phasing. Hole size can be as described above. Within each cluster the holes are positioned closely together, approximately an inch or two apart. The clusters of holes are spaced out every one to two feet. The actual dimensions and relative position of the streamholes will depend on milling limitations, costs, laboratory tests and well specific data. The liner is preferably perforated only in locations to be positioned in the production zone.

The liners of the invention can be used in place of conventionally ported liners, and with conventional completion techniques as are well known by those skilled in the art. For example, the liner can be used in vertical, highly deviated or horizontal wells. However, the invention is expected to provide its greatest benefit when used in wells having a lengthy completion interval, such as in a horizontal well (see FIG. 8), or multiple completion intervals, (see FIGS. 6 and 7).

Also, common solutions to problems encountered with conventionally ported completion liners are applicable to practice of the invention as well. For example, where the production zones are separated by a layer of an impermeable rock, such as shale, a packer or packers are generally employed to obtain best results. Where the invention is employed with a gravel pack, a covering screen or wire wrap or other technique for restricting the flow of particles is generally employed to prevent gravel particles for formation particles from obstructing the ports or entering the wellbore, in a manner known to the art.

Description of Illustrated Perfed Liner Embodiments

With reference to FIGS. 1-8, there is provided a well production tubular 2 having a longitudinal axis 4, a generally annular cross section across the longitudinal axis, a wellhead end 6, a well bottom end 8, and a plurality of influx ports 10 opening through a sidewall of the tubular to form a plurality of flow paths from an outer surface of the tubular to an inner surface of the tubular. The influx ports are formed through the sidewall at an obtuse angle B with respect to the longitudinal axis of the tubular in the direction of the wellhead end so that substantially all fluid flowing into the tubular exits the influx ports with a substantial axial velocity component toward the wellhead end of the tubular.

Generally speaking, the sidewall has a thickness and the influx ports have a diameter which is less than about 1.5 times the thickness. Preferably, the sidewall has a thickness and the influx ports have a diameter which is less than about 1.0 times the thickness. More preferably, the sidewall has a thickness and the influx ports have a diameter which is less than about 0.5 times the thickness.

In a preferred embodiment, the influx ports are arranged in a series of longitudinally separated banks 12 of influx ports, each bank containing a portion of the plurality. Preferably, the longitudinally separated banks of influx ports are separated by a longitudinal distance which is in the range of from about 0.5 to about 10 times the inside diameter. In another preferred embodiment, the influx ports are arranged in a series of circumferentially separated banks of influx ports, each bank containing a portion of the plurality. In this embodiment, adjacent banks can be separated by an angle A in the range of from about 30 degrees to about 180 degrees, as measured between bank centers through the longitudinal axis of the tubular, preferably by an angle A in the range of from about 45 to about 120 degrees, as measured between bank centers through the longitudinal axis of the tubular.

The obtuse angle with respect to the longitudinal axis of the tubular is generally in the range of from about 100 to about 170 degrees and is preferably in the range of from about 135 to about 160 degrees. The influx ports can be further formed so that substantially all fluid flowing into the tubular exits the influx ports with whirling flow toward the wellhead end of the tubular.

To provide rotational flow in accordance with an embodiment of the invention, there is provided a well production tubular 2' having a longitudinal axis 4', a generally annular cross section across the longitudinal axis, a wellhead end 6', and a well bottom end 8', and a plurality of influx ports 10' opening through the sidewall to form a plurality of flow paths from the outer surface of the tubular to the inner surface of the tubular. The influx ports are formed through the sidewall at an acute angle C with respect to a plane drawn through to the longitudinal axis of the tubular and passing through the port so that substantially all fluid flowing into the tubular exits the influx ports with a substantial rotational velocity component.

Generally speaking, the sidewall has a thickness and the influx ports have a diameter which is less than three times the thickness. Preferably, the sidewall has a thickness and the influx ports have a diameter which is less than two times the thickness. More preferably, the sidewall has a thickness and the influx ports have a diameter which is less than the thickness.

The influx ports can be arranged in a series of longitudinally separated banks 12' of influx ports, each bank containing a portion of the plurality. As described in terms of tubular inside diameter, the longitudinally separated banks of influx ports can be separated by a longitudinal distance which is in the range of from about 0.5 to about 10 times the inside diameter. The influx ports can also be arranged in a series of circumferentially separated banks of influx ports, each bank containing a portion of the plurality. Adjacent banks can be separated by an angle in the range of from about 30 degrees to about 180 degrees, as measured between bank centers through the longitudinal axis of the tubular, preferably an angle in the range of from about 45 to about 120 degrees, as measured between bank centers through the longitudinal axis of the tubular.

The acute angle with respect to the plane drawn through to the longitudinal axis of the tubular and passing through the influx port generally ranges from about 10 to about 80 degrees and is preferably in the range of from about 45 to about 80 degrees. The influx ports are preferably formed through the sidewall so that substantially all fluid flowing into the tubular exits the influx ports with whirling flow toward the wellhead end of the tubular.

One embodiment of the invention provides a well 20 for the production of hydrocarbons. The well comprises a borehole 22 extending into the earth from the surface of the earth into a hydrocarbon production zone 24. A well production tubular 2 is positioned in the borehole. The well production tubular has a longitudinal axis, a generally annular cross section across the longitudinal axis, a wellhead end, a well bottom end, and a plurality of influx ports opening through a sidewall of the tubular along a segment 26 of the tubular positioned in the hydrocarbon production zone. The ports form plurality of flow paths from an outer surface of the tubular to an inner surface of the tubular and are formed through the sidewall at an obtuse angle with respect to the longitudinal axis of the tubular in the direction of the wellhead end so that substantially all hydrocarbon flowing from the hydrocarbon production zone and into the tubular exits the influx ports with a substantial axial velocity component toward the wellhead end of the tubular. The production tubular is preferably substantially imperforate apart from the segment of the tubular positioned in the hydrocarbon production zone. The well can be highly deviated from vertical in the production zone.

Preferably, the well includes a casing 28 which lines the borehole from the surface of the earth to the hydrocarbon production zone. The casing is positioned between the well production tubular and the earth and is perforated by perforations 30 in the hydrocarbon production zone to permit hydrocarbon to flow from the earth, though the casing, into the well production tubular and to the surface of the earth.

Generally speaking, an annulus 32 is formed between the casing and the well production tubular. Preferably, a packer 34 is sealingly positioned in the annulus spaced apart from the hydrocarbon production zone to channel hydrocarbon flow from the hydrocarbon production zone, through the influx ports, and into the production tubular.

If desired, a screen 36 can be positioned in the annulus to prevent particles which cannot pass through the screen from obstructing the influx ports in the production tubular. A gravel pack 38 can be positioned in the annulus between the screen and the production zone which is sized to prevent gravel particles from obstructing the influx ports in the production tubular.

The ports can also impart swirling flow to the fluids flowing into the tubular. For this application, The influx ports are further formed through the sidewall of the well production tubular at an acute angle in the range of about 10 degrees to about 80 degrees with respect to a plane drawn through to the longitudinal axis of the well production tubular and passing through the port so that substantially all fluid flowing into the well production tubular exits the influx ports with a substantial rotational velocity component.

Concentric Tubing and Packer System Embodiment

The second described embodiment of the invention employs a concentric tubing and packer system (CTAP system) to accomplish this the above described objective. See FIGS. 9 and 10. This method is primarily intended for horizontal or vertical wells with commingled production from multiple intervals.

The CTAP system is very similar to the classic means of separately producing two intervals, one through the tubing and the other via the annulus. The distinguishing characteristic for the CTAP system is that the concentric tubing is not run all the way up the wellhead. Instead, the concentric tubing is run a short distance beyond the interval being produced via the annulus formed by the CTAP. The concentric tubing is preferably held in place with a packer, which is positioned between the two producing intervals and forms a seal at the lower end of the CTAP. In addition, the concentric tubing is preferably held by a tubing anchor located down-stream of the interval producing from the annulus. The tubing anchor should achieve the following objectives: 1) Allow minimal flow restriction at the end of the annulus, 2) Allow flexibility in setting and removing, 3) centralize the tubing in the casing. Also, the downstream end of the tubing should be tapered to minimize turbulence at the commingling point due to end-of-pipe drag.

In general, the CTAP system forces the streamlines to run parallel and then commingles the production from the separate intervals. This example refers to a well with only two separate intervals. See FIG. 9. However, this method can be applied to wells with more than two separate intervals. In such a case there would be multiple CTAP's stacked on top of each other. See FIG. 10.

Where the production zones are separated by a layer of an impermeable rock, such as shale, a packer or packers are generally employed alongside or downstream of the such zone.

Further Details of Concentric Tubing and Packer System Embodiment

The completion tubular will generally have an inside diameter of from about 2 inches to about 8 inches (50 mm to 200 mm). The wall thickness of the completion tubular can vary over a wide range, but will usually be in the range of about 5/64ths to 1/4 inch (2 to 6 mm). The outside diameter of the completion tubular will generally range from 50% to 90% of the inside diameter of the casing. Although any length completion tubular placed inwardly from the perforations will provide some benefit, the length is preferably only slightly more than the length of the perforated section of the casing, such as in the range of 100% to 150% of the length of the perforated section of the casing.

Description of Illustrated Concentric Tubing and Packer System Embodiment

Figure 9:
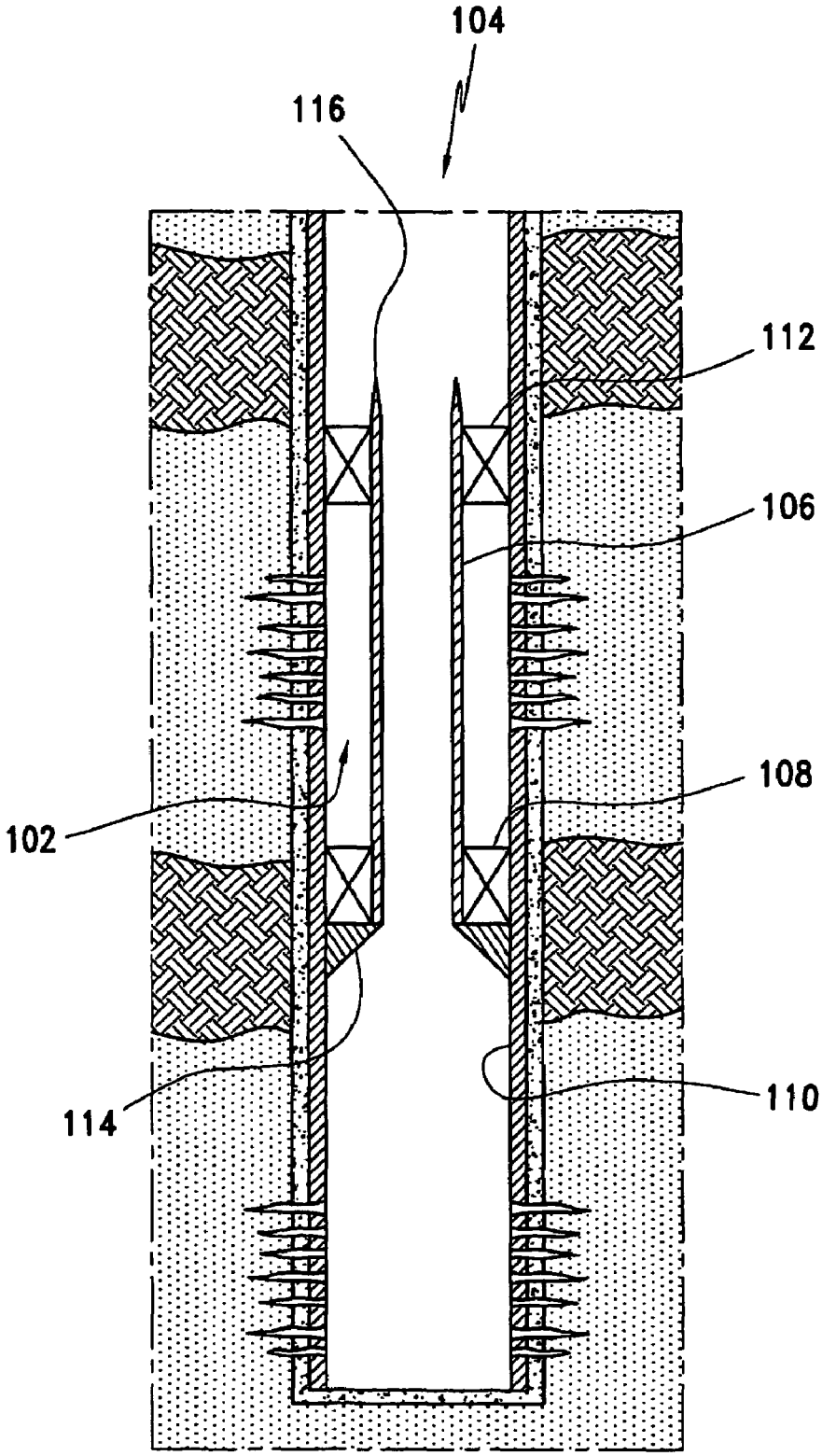
FIG. 9 is a schematic illustration of a completion system employed to produce from two production intervals.
Figure 10:
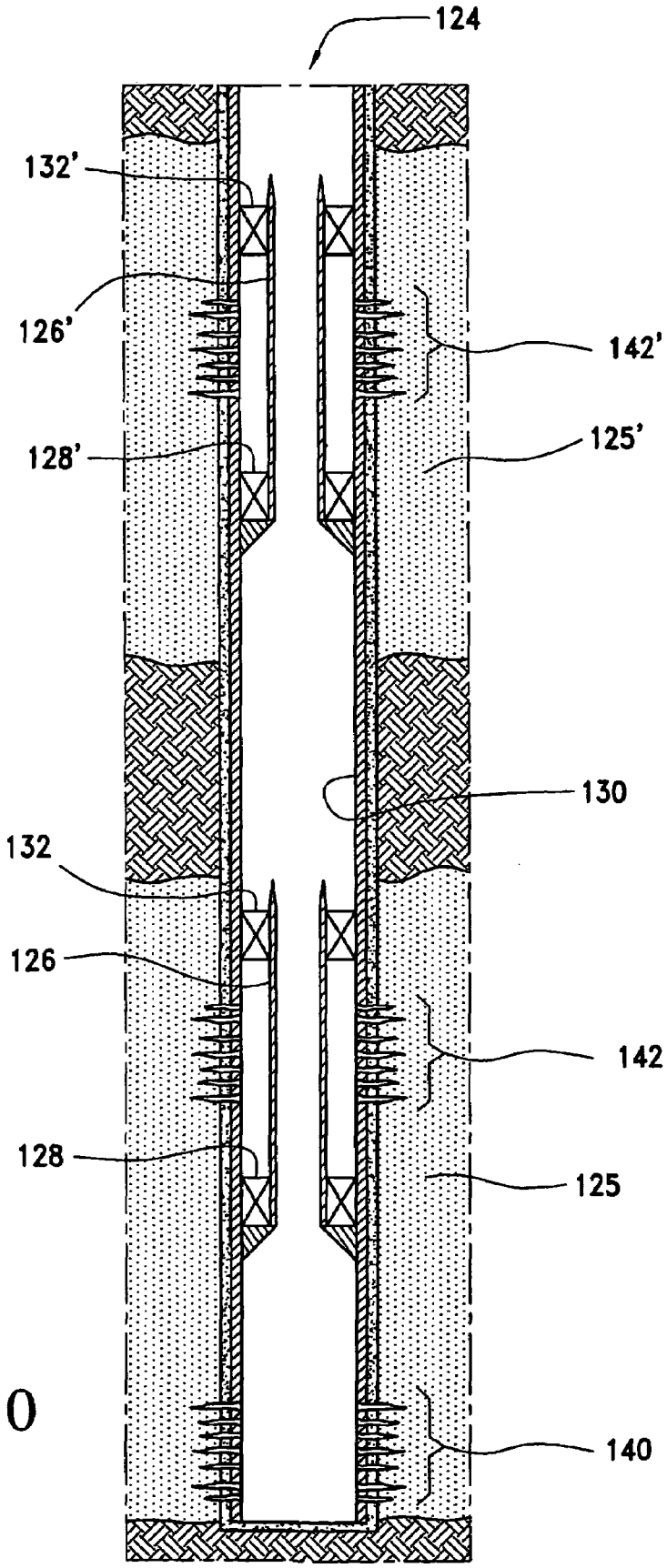
FIG. 10 is a schematic illustration of a completion system employed to produce from more than two production intervals.

With reference to FIGS. 9 and 10, there is provided a concentric tubing and mounting system 102 for use in completing a well 104. The system comprises a tubular member 106 having an inlet end, an outlet end, and a longitudinal axis extending between the ends. A first mounting device 108 is positioned on an outside surface of the tubular member near the inlet end of the tubular member for mounting the inlet end of the tubular member on an inside surface of a well production tubing 110. A second mounting device 112 is positioned on an outside surface of the tubular member near the outlet end of the tubular member for mounting the outlet end of the tubular member to the inside surface of a well production tubing. Preferably, the first mounting device is annularly shaped and is selectively expandable for setting securely against an inside of a well production tubing. The second mounting device preferably defines a plurality of flow paths to permit fluid flow through the mounting device in a direction parallel to the longitudinal axis of the tubular member.

A converging inlet element 114 can be positioned on the inlet end of the tubular member to provide a smoothly narrowing fluid flow path from an inside surface of a well production tubing to the inside of the tubular member. The outlet end of the tubular member can be defined by an inside surface of the tubular member coming together with an outside surface of the tubular member along a beveled edge 116.

The device can be deployed in a well 124 for the production of hydrocarbons. The well comprises a borehole extending into the earth from a wellhead at the surface of the earth and into a hydrocarbon production zone 125. A production tubing 130 is positioned in the borehole and extending into the hydrocarbon production zone from the wellhead. The production tubing has a first perforated section 140 positioned in the hydrocarbon production zone and a second perforated section 142 positioned between the first perforated section and the wellhead. A completion tubing 126 is provided having an inlet end, an outlet end, and a longitudinal axis extending between the ends. A first mounting device 128 positioned on an outside surface of the completion tubing near the inlet end of the completion tubing mounting the inlet end of the completion tubing to an inside surface of the production tubing between the first perforated section and the second perforated section. A second mounting device 132 is positioned on the outside surface of the completion tubing near the outlet end of the completion tubing mounting the outlet end of the completion tubing to the inside surface of the well production tubing between the second perforated section and the wellhead. Fluid flowing into the production tubing through the perforations of the second perforated section flows into an annulus defined between the completion tubing and the production tubing.

In one embodiment of the invention, the second perforated section is positioned in the first production zone. In another embodiment, the second perforated section is positioned in a second production one 125'. In a further embodiment, the hydrocarbon production zone constitutes a first hydrocarbon production zone 125, and the borehole further extends through a second hydrocarbon production zone 125' positioned between the first hydrocarbon production zone and the wellhead. The production tubing further has a third perforated section 142' positioned between the second perforated section and the wellhead alongside the second hydrocarbon production zone. The completion tubing constitutes a first completion tubing. The well further includes a second completion tubing 126' positioned between the first completion tubing and the wellhead. The second completion tubing has an inlet end, an outlet end, and a longitudinal axis extending between the ends. A first mounting device 128' is positioned on an outside surface of the second completion tubing near the inlet end of the second completion tubing mounting the inlet end of the second completion tubing on an inside surface of the production tubing between the second perforated section and the third perforated section. A second mounting device 132' is positioned on the outside surface of the second completion tubing near the outlet end of the second completion tubing mounting the outlet end of the second completion tubing to the inside surface of the well production tubing between the third perforated section and the wellhead. Fluid flowing into the production tubing through the perforations of the third perforated section flows into an annulus defined between the completion tubing and the production tubing.

The above described device can be used to carry out an improved method of hydrocarbon production from a well. The method to be improved comprises flowing hydrocarbons through a production tubing positioned in the well from a first set of perforations to a wellhead, and bringing additional hydrocarbons into the production tubing through a second set of perforations positioned between the first set of perforations and the wellhead. The improvement comprises dividing the production tubing into an axial passage and an annular passage alongside the second set of perforations. The hydrocarbons from the first set of perforations are flowed through the axial passage as an axial stream toward the wellhead. The hydrocarbons from the second set of perforations are flowed through the annular passage as an annular stream toward the wellhead. The axial stream and the annular stream are combined at a location between the second set of perforations and the wellhead. The method preferably causes the production of hydrocarbons from one first set of perforations to be increased, and the overall production of hydrocarbons from the well to be increased.

Perfed Casing Embodiment

A third embodiment of the invention employs a casing perfed for angled fluid influx to accomplish this. See FIGS. 11 and 12. By perfed is meant provided with perforations or ports. In practice, the perforations are formed in situ using a perforation gun set up to perforating the casing and cement at the desired angle, or by down-hole milling.

The perfs preferably open through the casing pointed directly toward the longitudinal axis of the tubular, angled in the direction of flow of wellbore fluids, so that fluid is emitted from the perf with an axial velocity component along the axis of the wellbore casing. Conventional practice would be to perforate the casing at a right angle from the wellbore axis. The angle (acute side) between the axis of the casing and the axis of the perf can range from 10 degrees to 80 degrees, usually between 20 degrees and 45 degrees, and all of the perfs point in the same direction, preferably at the same angle. The obtuse angle D shown in the drawing is 180 degrees minus the acute angle. The design in cross section appears as a "herring bone" pattern. The situation can be analogized to merge ramps on a highway. Most highways have entrance and exit ramps that merge smoothly in to and out of traffic. That is, the entrance and exit ramps are not perpendicular to the highway. As a result, with the exception of some courteous yielding, vehicles are capable of entering and exiting a highway without slowing down the speed of the other cars on the highway.

For maximum effectiveness, the number of slanted perforations would need to be limited. In conventional vertical completions, it is common to have a perforation density of four shots per foot (spf). However, this density can be reduced to 1 or ½ spf for a horizontal well without significantly affecting the well's productivity, and under good formation conditions, can be even further apart. By reducing the number of entry points for the flow into the wellbore, there is less interference of the fluid flow lines in the wellbore. Choosing the optimum perforation density requires balancing the tradeoff of maximizing reservoir access while minimizing the flow interference in the wellbore.

Axial perfs will provide lower flow resistance per unit length of casing than normal perfs, all other things being equal. Flow resistance per unit length along the perforated section of the casing can be further reduced by reducing the perf diameter, reducing the number of perfs per unit length, and incrementally changing the position of the axial perfs on the circumference of the casing between adjacent longitudinal positions, so as to bring in the influx flow streams through the perfs from locations around the entire periphery of the casing in a cyclical, crankshaft-layout-type fashion. Where the axial perfs are employed in groups, it is expected that the groups will be positioned in areas best described as circumferentially-extending strips or banks.

The industry has developed techniques designed to maximize the penetration and size of a perforation charge. The primary measures of perforation performance are defined as the depth of penetration and perforation tunnel diameter. In order to achieve the current state-of-the-art performance requires shooting the perforation charges at a right angle from within the wellbore. Changing the inclination of the perforation guns will influence the depth of penetration.

Further Details of Preferred Perfed Casing Embodiments

The casing will generally have an inside diameter of from about 2 inches to about 15 inches (50 mm to 375 mm). The wall thickness of the casing can vary over a wide range, but will usually be in the range of about 5/64ths to 1 inch (2 to 25 mm). The perfs will generally have a diameter of less than about 30% of the casing inside diameter, usually less than 20% of the casing diameter, and frequently less than 10% of the casing diameter. Where the casing is set in cement, the perforations extend through the cement and into the formation.

Where the perfs are deployed in banks, each bank will generally contain in the range of from 1 to 20 perfs, usually in the range of from 2 to 12 perfs. The banks are preferably separated by a phase angle in the range of from about 30 degrees to about 180 degrees, usually in the range of from 45 degrees to 120 degrees, as measured between the centers of the banks, and a distance as measured longitudinally between the banks in the range of from 0.5 to 10, usually 1 to 5, times the inside diameter of the casing.

A design consideration for the angled fluid influx casing is reducing the perforation diameter to allow greater control in terms of customizing the orientation and inclination of the openings in the casing. This greater control increases the ability to merge the influx flow streams with the wellbore flow streams. However, the invention is equally applicable to currently oil industry practices in terms of perforation diameters and phasing of the perforation holes. As a further measure of reducing flow resistance, clusters of perforations can be spaced apart from other clusters. The clusters of perforations can be spaced several feet apart, depending on reservoir characteristics, for example, every one to two feet, or more. The actual dimensions and relative position of the stream-perforations will depend on milling limitations, costs, laboratory tests and well specific data. The casing is preferably perforated only in locations positioned in the production zone.

The casings of the invention can be used with conventional completion techniques as are well known by those skilled in the art. For example, the casing can be used in vertical, highly deviated or horizontal wells. However, the invention is expected to provide its greatest benefit when used in wells having a lengthy completion interval, such as in a horizontal well, or multiple completion intervals.

Description of Illustrated Perfed Casing Embodiments

Figure 11:
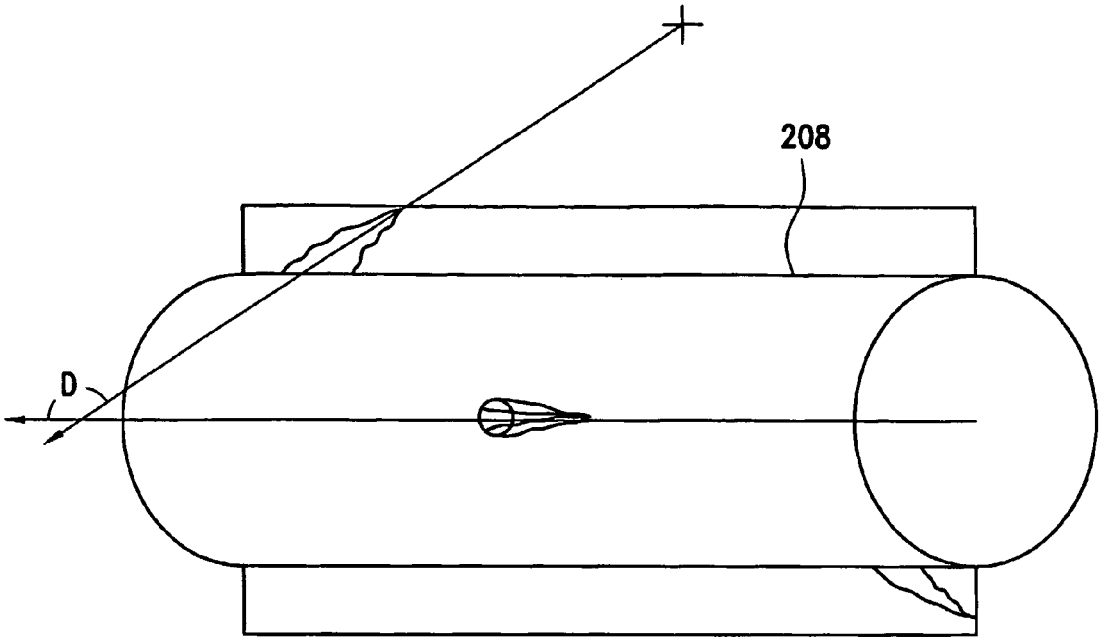
FIG. 11 is a schematic illustration of a casing segment in accordance with an embodiment of the invention which is provided with perforations angled axially to reduce flow resistance due to influx across a completion interval of a well.
Figure 12:
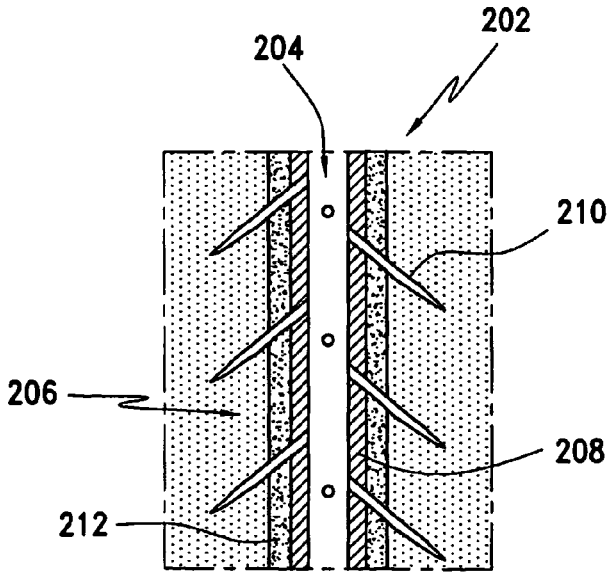
FIG. 12 is a longitudinal section of a well segment in accordance with an embodiment of the invention.

With reference to FIGS. 11 and 12, there is provided a well 202 for the production of hydrocarbons. The well comprises a well bore 204 extending into the earth from the surface of the earth into a hydrocarbon production zone 206, and a well bore casing 208 positioned in the borehole. The well bore casing has a longitudinal axis, a generally annular cross section across the longitudinal axis, a wellhead end, a well bottom end, and a plurality of perforations 210 opening through a sidewall of the casing along a segment of the casing positioned in the hydrocarbon production zone. The perforations form plurality of flow paths from an outer surface of the casing to an inner surface of the casing and are formed through the sidewall at an obtuse angle D with respect to the longitudinal axis of the casing in the direction of the wellhead end so that substantially all hydrocarbon flowing from the hydrocarbon production zone and into the casing exits the perforations with a substantial axial velocity component toward the wellhead end of the casing.

Generally speaking, a cement layer 212 lines the wellbore at least across the hydrocarbon production zone. The cement layer is positioned between the well bore casing and the earth and is perforated by the perforations to permit hydrocarbon to flow from the earth, though the cement layer, into the well bore casing and to the surface of the earth. The cement is typically positioned in an annulus between the casing and the well bore.

If desired, the well can be highly deviated from vertical in the production zone. The well bore casing preferably substantially imperforate apart from the segment of the casing positioned in the hydrocarbon production zone.

The perforations generally have a diameter which is less than about 30% of the casing diameter, usually less than about 20% of the casing diameter, and preferably less than about 10% of the casing diameter.

In a preferred embodiment, the casing has an inside diameter and the perforations are arranged in a series of longitudinally separated banks. The longitudinally separated banks of perforations are separated by a longitudinal distance which is in the range of from about 0.5 to about 10 times the inside diameter of the casing. The banks can also be arranged in a series of circumferentially separated banks of perforations, each bank containing a portion of the plurality. In this embodiment, adjacent banks can be separated by an angle in the range of from about 30 degrees to about 180 degrees, as measured between bank centers through the longitudinal axis of the casing, preferably by an angle in the range of from about 45 to about 120 degrees, as measured between bank centers through the longitudinal axis of the casing.

The obtuse the obtuse angle with respect to the longitudinal axis of the casing is usually in the range of from about 100 to about 170 degrees and is preferably in the range of from about 135 to about 160 degrees.

The invention claimed is:

1. A well production tubular (2) for carrying fluids from a wellbore, said tubular having a longitudinal axis (4), a generally annular cross section across the longitudinal axis, a wellhead end (6), a well bottom end (8), and a plurality of influx ports (10) opening through a sidewall of the tubular to form a plurality of flow paths from an outer surface of the tubular to an inner surface of the tubular, said influx ports being formed through the sidewall at an obtuse angle B with respect to the longitudinal axis of the tubular in the direction of the wellhead end so that substantially all fluid flowing into the tubular exits the influx ports with a substantial axial velocity component toward the wellhead end of the tubular, wherein the sidewall has a thickness and the influx ports have a diameter which is less than about 1.5 times the thickness, said influx ports opening directly toward the longitudinal axis of the tubular.

2. A well production tubular as in claim 1 in which the obtuse angle B is in the range of from 135 to 160 degrees.

3. A well production tubular as in claim 1 in which the sidewall has a thickness and the influx ports have a diameter which is less than about 1.0 times the thickness.

4. A well production tubular as in claim 1 in which the sidewall has a thickness and the influx ports have a diameter which is less than about 0.5 times the thickness.

5. A well (20) for the production of hydrocarbons, comprising a borehole (22) extending into the earth from the surface of the earth into a hydrocarbon production zone (24), and a well production tubular as in claim 1 positioned in the borehole, said plurality of influx ports opening through a sidewall of the tubular along a segment (26) of the tubular positioned in the hydrocarbon production zone.

6. A well as in claim 5 further comprising a casing (28) which lines the borehole from the surface of the earth to the hydrocarbon production zone, said casing being positioned between the well production tubular and the earth and being perforated by perforations (30) in the hydrocarbon production zone to permit hydrocarbon to flow from the earth, though the casing, into the well production tubular and to the surface of the earth.

7. A well as in claim 6 wherein an annulus (32) is formed between the casing and the well production tubular.

8. A well as in claim 7 further comprising a packer (34) sealingly positioned in the annulus spaced apart from the hydrocarbon production zone to channel hydrocarbon flow from the hydrocarbon production zone, through the influx ports, and into the production tubular.

9. A well as in claim 5, wherein the well production tubular comprises a well bore casing (208) positioned in the borehole, and the plurality of influx ports comprise a plurality of perforations (210) opening through a sidewall of the casing along a segment of the casing positioned in the hydrocarbon production zone.

10. A well as in claim 9 further comprising a cement layer (212) which lines the wellbore at least across the hydrocarbon production zone, said cement layer being positioned between the well bore casing and the earth and being perforated by the perforations to permit hydrocarbon to flow from the earth, though the cement layer, into the well bore casing and to the surface of the earth.

11. A well as in claim 10 wherein the cement is positioned in an annulus between the casing and the well bore.

12. A well as in claim 9 which is highly deviated from vertical in the production zone.

13. A well as in claim 9 wherein the well bore casing is substantially imperforate apart from the segment of the casing positioned in the hydrocarbon production zone.

14. A well production tubular (2') having a longitudinal axis (4'), a generally annular cross section across the longitudinal axis, a wellhead end (6'), a well bottom end (8'), and a plurality of influx ports (10') opening through the sidewall to form a plurality of flow paths from the outer surface of the tubular to the inner surface of the tubular, said influx ports being formed through the sidewall at an acute angle C with respect to a plane drawn through to the longitudinal axis of the tubular and passing through the port so that substantially all fluid flowing into the tubular exits the influx ports with a substantial rotational velocity component.

15. A well production tubular as in claim 14 in which the sidewall has a thickness and the influx ports have a diameter which is less than three times the thickness.

16. A well production tubular as in claim 14 in which the sidewall has a thickness and the influx ports have a diameter which is less than two times the thickness.

17. A well production tubular as in claim 14 in which the sidewall has a thickness and the influx ports have a diameter which is less than the thickness.

18. A well production tubular as in claim 14 wherein the influx ports are arranged in a series of longitudinally separated banks (12') of influx ports, each bank containing a portion of the plurality.

19. A concentric tubing and mounting system (102) for use in completing a well (104), said system comprising a tubular member (106) having an inlet end, an outlet end, and a longitudinal axis extending between the ends, a first mounting device (108) positioned on an outside surface of the tubular member near the inlet end of the tubular member for mounting the inlet end of the tubular member on an inside surface of a well production tubing (110);

a second mounting device (112) positioned on an outside surface of the tubular member near the outlet end of the tubular member for mounting the outlet end of the tubular member to the inside surface of a well production tubing, wherein the second mounting device defines a plurality of flow paths to permit fluid flow through the mounting device in a direction parallel to the longitudinal axis of the tubular member.

20. A concentric tubing and mounting system as in claim 19 wherein the first mounting device is annularly shaped and is selectively expandable for setting securely against an inside of a well production tubing.

21. A concentric tubing and mounting system as in claim 19 further comprising a converging inlet element (114) positioned on the inlet end of the tubular member to provide a smoothly narrowing fluid flow path from an inside surface of a well production tubing to the inside of the tubular member.

22. A well (124) for the production of hydrocarbons, comprising a borehole extending into the earth from a wellhead at the surface of the earth and into a hydrocarbon production zone (125), a production tubing (130) positioned in the borehole and extending into the hydrocarbon production zone from the wellhead, said production tubing having a first perforated section (140) positioned in the hydrocarbon production zone and a second perforated section (142) positioned between the first perforated section and the wellhead, a completion tubing (126) having an inlet end, an outlet end, and a longitudinal axis extending between the ends, a first mounting device (128) positioned on an outside surface of the completion tubing near the inlet end of the completion tubing mounting the inlet end of the completion tubing to an inside surface of the production tubing between the first perforated section and the second perforated section, and a second mounting device (132) positioned on the outside surface of the completion tubing near the outlet end of the completion tubing mounting the outlet end of the completion tubing to the inside surface of the well production tubing between the second perforated section and the wellhead, said outlet end of the completion tubing being positioned a short distance above the second perforated section, whereby fluid flowing into the production tubing through the perforations of the second perforated section flows into an annulus defined between the completion tubing and the production tubing.

23. A well as in claim 22 wherein the second perforated section is positioned in the first production zone.

24. A well as in claim 22 wherein the second perforated section is positioned in a second production zone (125').

25. A well as in claim 22 wherein the hydrocarbon production zone constitutes a first hydrocarbon production zone (125), and the borehole further extends through a second hydrocarbon production zone (125') positioned between the first hydrocarbon production zone and the wellhead, the production tubing further has a third perforated section (142') positioned between the second perforated section and the wellhead alongside the second hydrocarbon production zone, and the completion tubing constitutes a first completion tubing, said well further comprising a second completion tubing (126') positioned between the first completion tubing and the wellhead, said second completion tubing having an inlet end, an outlet end, and a longitudinal axis extending between the ends;

a first mounting device (128') positioned on an outside surface of the second completion tubing near the inlet end of the second completion tubing mounting the inlet end of the second completion tubing on an inside surface of the production tubing between the second perforated section and the third perforated section, and a second mounting device (132') positioned on the outside surface of the second completion tubing near the outlet end of the second completion tubing mounting the outlet end of the second completion tubing to the inside surface of the well production tubing between the third perforated section and the wellhead, said outlet end of the second completion tubing being positioned a short distance above the third perforated section, whereby fluid flowing into the production tubing through the perforations of the third perforated section flows into an annulus defined between the completion tubing and the production tubing.

* * * * *